United States Patent [19]

Meinel et al.

[11] 4,333,379

[45] Jun. 8, 1982

[54] STRINGING FOR MUSICAL INSTRUMENTS

[76] Inventors: Erhard Meinel; Käthe Meinel, both of Wallensteinstr. 24, Geretsried D-8192, Fed. Rep. of Germany

[21] Appl. No.: 256,069

[22] Filed: Apr. 21, 1981

[30] Foreign Application Priority Data

Apr. 30, 1980 [DE] Fed. Rep. of Germany ..... 3016723

[51] Int. Cl.[3] ..... G10D 3/10

[52] U.S. Cl. ..... 84/297 S

[58] Field of Search ..... 84/297 S

[56] References Cited

U.S. PATENT DOCUMENTS 2,710,557 6/1955 Sundt ..... 84/297 S

FOREIGN PATENT DOCUMENTS 2604693 8/1977 Fed. Rep. of Germany .... 84/297 S

*Primary Examiner*—Lawrence R. Franklin

*Attorney, Agent, or Firm*—Bacon & Thomas

[57] ABSTRACT

Stringing for plucked musical instruments with treble strings, low note strings with steel core and wire wrapping, and possibly bass strings with steel core, wire under-wrapping, and wire wrapping, the treble strings and the steel cores of the low note and bass strings consisting of bronzed gray cast steel, which is tinned or nickeled or has a coating of a ferromagnetic, corrosion-resistant metal alloy, characterized in the improvement that the treble strings and the steel cores of the low note and bass strings have additionally a surface coating of gold, the wrapping wire of the low note and bass strings consists of nickeled iron or an iron/nickel alloy with a surface coating of gold, and the wire under-wrapping of the bass strings consists of Siemens-Martin iron wire.

4 Claims, No Drawings

STRINGING FOR MUSICAL INSTRUMENTS

BACKGROUND OF THE INVENTION

The invention relates to stringing for plucked musical instruments of the type provided with treble strings, low note strings with steel core and wire wrapping, and possibly bass strings with steel core, wire under-wrapping and wire wrapping; the treble strings, and the steel cores of the low note and bass strings, consisting of bronzed gray cast steel, which is tinned or nickeled or has a coating of a ferromagnetic, corrosion-resistant metal alloy.

Such a stringing is in particular suitable for guitars with electromagnetic sound amplification.

Metal strings for musical instruments are known; in general, steel strings are used for stringing plucked musical instruments. The surface of such strings is in general tinned, coppered or nickeled, in order to suppress the strongly corrosive effect of hand perspiration and the room atmosphere to which such instruments, such as guitars, lutes, and the like, are exposed.

The stringing, for example for electric guitars, as a rule consists of at least 6 strings which are made of metal wire. With the usual stringing, as a rule at least two strings, namely the strings for the high notes, but frequently, however, also three strings (e.g., G, B flat, top E) are made of bright, tinned steel wire which has no wrapping with further metal wires. The other three or four strings, as the case may be, namely the strings for low notes, consist in general of steel wire, which is preferably wrapped with a nickel wire.

The use of different materials with different electromagnetic properties for string of, for example, an electric guitar gives, on electromagnetic amplification, a distorted tone, different sound intensity and deficient purity of tone, since the electromagnetic sound pickups on the guitar respond differently to the different materials of the strings. Besides, the corrosion resistance of the different strings of such a conventional stringing is too low and is quite variable.

SUMMARY OF THE INVENTION

The object of the invention is to provide metal strings for plucked musical instruments, in particular for electric guitars and similar musical instruments which, on the one hand are corrosion-resistant and to which, on the other hand, the electromagnetic sound pickups respond uniformly, precisely and strongly, so as to extend the life of the strings in practical musical use and in order to obtain, and to keep constant, a purer, undistorted overall sound of greater tone.

DETAILED DESCRIPTION

The object of the invention is attained by a stringing of the kind mentioned above, which is improved in that the treble strings and steel cores of the low note strings and bass strings have, additionally, a surface coating of gold; the wrapping wire of the low note strings and bass strings (where used) consist of nickeled iron or an iron/-nickel alloy with a surface coating of gold, and the underwrapping wire of the bass strings (where used) consists of Siemens-Martin iron wire.

Advantageously the under-wrapping wire of the bass strings is also gilded.

The strings according to the invention are extraordinarily corrosion-resistant and have practically equal electromagnetic properties from one to the other. They therefore possess a substantially extended life, hold the sound better, i.e. the sound spectrum remains completely maintained and they tend not to go out of tune so quickly as the conventional strings, and offer a maximum of uniformity and intensity of sound amplification. The stringing according to the invention has a sound which has optimum tone purity for all six strings of the guitar stringing. This gives a harmoniously overall tonal sound which can be amplified particularly loudly and purely.

With the stringing according to the invention, all components of the strings can, if desired, be made highly corrosion-resistant by additional gilding. The gold coating is magnetically permeable, adheres very well to the substrate of nickel and iron or steel, and is sufficiently resistant against the abrasion of the fingers.

With intensive use, a conventional guitar stringing must be renewed daily or at least every three days, since it quickly corrodes and hence cannot keep the sound constant. Changes of sound immediately occur with the sensitive amplifier equipment used today.

As against this, the strings according to the invention have a substantially longer life and the sound can be kept constant for a substantially longer time with them.

The strings according to the invention can be completely cleaned with a warm, damp cloth or with a cloth saturated with alcohol, and the original sound quality can be thereby regained.

By the stringing equipped according to the invention, the result is obtained that the electromagnetic sound pickups respond with the same precision and intensity to the treble strings as to the low note strings, and at the same time the greatest possible corrosion resistance and abrasion resistance are ensured.

Thus stringing of this kind is optimum for electromagnetic sound amplification. The notes produced by these strings are picked up most precisely by the magnets of the electrical sound amplification equipment, the sound is kept constant, and playing with strings of this kind thus gives a sound of particularly pure tone.

Gilding of the strings is carried out conventionally.

The steel cores used can, as usual, be round or hexagonal in cross section.

We claim:

1. In stringing for plucked musical instruments provided with treble strings and with low note strings with steel core, and wire wrapping, wherein the treble strings and the steel cores of the low note strings consist of bronzed gray cast steel, which is tinned or nickeled or has a coating of a ferromagnetic, corrosion-resistant metal alloy, the improvement characterized in that the treble strings and the steel cores of the low note strings additionally have a surface coating of gold and the wrapping wire of the low note strings consists of nickeled iron or an iron/nickel alloy with a surface coating of gold.

2. Stringing according to claim 1 further provided with bass strings with steel core consisting of bronzed gray cast steel, which is tinned or nickeled or has a coating of a ferromagnetic, corrosion-resistant metal alloy, wire under-wrapping and wire wrapping, characterized by the further improvement in that the steel core of the bass strings additionally has a surface coating of gold, the wrapping wire consists of nickeled iron or an iron/nickel alloy with a surface coating of gold, and the wire under-wrapping consists of Siemens-Martin iron wire.

3. Stringing according to claim 2, characterized in that the under-wrapping wire of the bass strings is also gilded.

4. Stringing according to claim 1, 2 or 3, characterized in that the iron/nickel alloy of the wrapping wire contains about 40–50 wt. % iron.

* * * * *